US005867184A

United States Patent [19]

Quintana

[11] Patent Number: 5,867,184

[45] Date of Patent: Feb. 2, 1999

[54] UNIVERSAL CAP FOR DIFFERENT STYLE INKJET PRINTHEADS

[75] Inventor: Jason Quintana, Vancouver, Wash.

[73] Assignee: Hewlett-Packard Company, Palo Alto, Calif.

[21] Appl. No.: 566,221

[22] Filed: Nov. 30, 1995

[51] Int. Cl.[6] ..... B41J 2/165

[52] U.S. Cl. ..... 347/29; 347/24

[58] Field of Search ..... 347/24, 44, 29, 347/30

[56] References Cited

U.S. PATENT DOCUMENTS

| | | | |
|---|---|---|---|
| 5,396,271 | 3/1995 | Premnath | 347/33 |
| 5,426,456 | 6/1995 | Kuelzer et al. | 347/29 |
| 5,440,331 | 8/1995 | Grange | 347/33 |
| 5,517,220 | 5/1996 | English | 347/29 |
| 5,563,637 | 10/1996 | Francis et al. | 347/33 |
| 5,712,668 | 1/1998 | Osborne et al. | 347/32 |

FOREIGN PATENT DOCUMENTS

| | | | |
|---|---|---|---|
| 59-45162 | 3/1984 | Japan | 347/33 |
| 59-45163 | 3/1984 | Japan | 347/33 |
| 59-209876 | 11/1984 | Japan | 347/33 |
| 3-90362 | 4/1991 | Japan | 347/33 |
| 3-99857 | 4/1991 | Japan | 347/33 |
| 4-37556 | 2/1992 | Japan | 347/33 |
| 4-338552 | 11/1992 | Japan | 347/33 |

*Primary Examiner*—Benjamin R. Fuller
*Assistant Examiner*—Thien Tran
*Attorney, Agent, or Firm*—Flory L. Martin

[57] ABSTRACT

A universal capping system seals the printhead of either a single-chamber or a multi-chamber style inkjet cartridge, such as a black ink cartridge or a multi-color ink cartridge installed in an inkjet printing mechanism. In an imaging inkjet cartridge system, the normal single-chamber black cartridge for printing text is replaced with a multi-chamber imaging cartridge. Some imaging cartridges carry ink formulations having reduced colorant concentrations, which, when used in conjunction with a full color cartridge carrying full colorant concentrations of color inks, provides near photographic image quality, as well as crisp black text and line art. The printing mechanism is provided with a universal capping system, including several banks of flexible sealing sublips, capable of sealing either style cartridge when installed. One sublip has an asymmetrical cross section selected to control the direction of bending. The cap is spring-biased to push the sealing lips into engagement with the installed printhead.

28 Claims, 9 Drawing Sheets

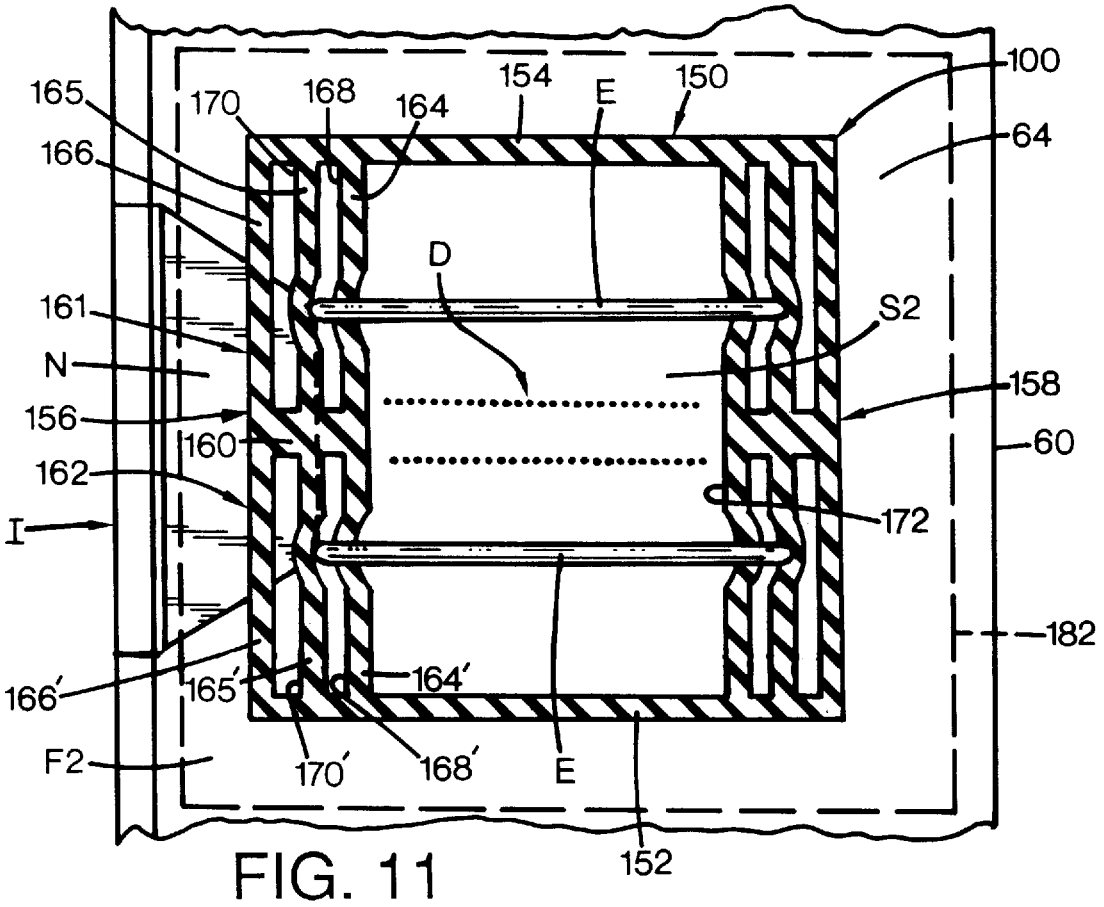
FIG. 11
FIG. 12
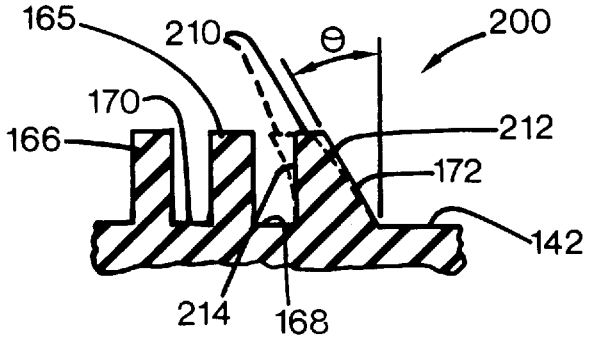

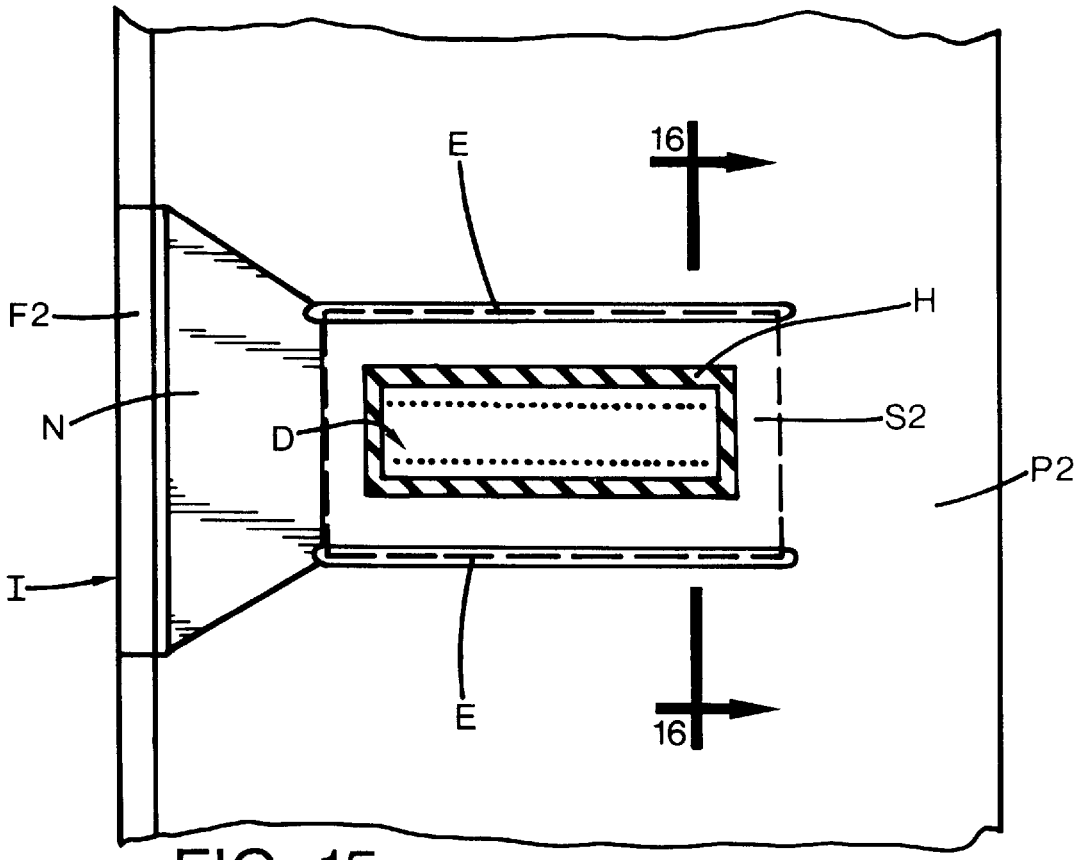
FIG. 15
Prior Art
FIG. 16
Prior Art
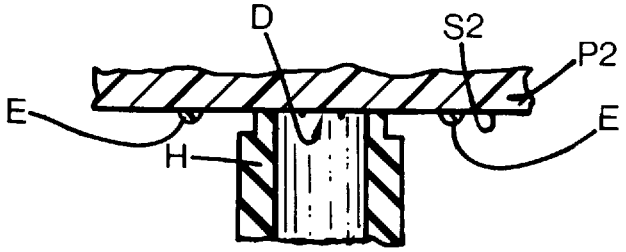

UNIVERSAL CAP FOR DIFFERENT STYLE INKJET PRINTHEADS

FIELD OF THE INVENTION

The present invention relates generally to inkjet printing mechanisms, and more particularly to a universal capping system that seals the printhead of either a single-chamber or a multi-chamber style inkjet cartridge, such as a black ink cartridge or a multi-color ink cartridge.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead.

To improve the clarity and contrast of the printed image, recent research has focused on improving the ink itself. To provide faster, more waterfast printing with darker blacks and more vivid colors, pigment based inks have been developed. These pigment based inks have a higher solid content than the earlier dye based inks, which results in a higher optical density for the new inks. Both types of ink dry quickly, which allows inkjet printing mechanisms to form high quality images on readily available and economical plain paper.

Early inkjet printers used a single monochromatic pen, typically carrying black ink. Later generations of inkjet printing mechanisms used a black pen which was interchangeable with a tri-color pen, typically one carrying the colors of cyan, magenta and yellow within a single cartridge. The tri-color pen was capable of printing a "process" or "composite" black image, by depositing a drop of cyan, a drop of magenta, and a drop of yellow ink all at the same location. Unfortunately, images printed with the composite black usually had rough edges, and the overall image, even the color portions, often had a non-black hue or cast, depending for instance, upon the type of paper used.

The next generation of printers further enhanced the images by using a dual pen system. These dual pen printers provided a black pen along with a tri-color pen, both of which were mounted in a single carriage. These dual pen devices had the ability to print crisp, clear black text while providing full color images. As another answer to the dissatisfaction with the composite black images, a quad pen printing mechanism was developed. These quad pen printers carried four cartridges in a single carriage. Quad pen plotters were also developed, some of which carried four cartridges, one in each of four carriages. These quad printing mechanisms had a first pen carrying black ink, a second pen carrying cyan ink, a third pen carrying magenta ink, and a fourth pen carrying yellow ink.

Unfortunately, both the quad pen printers and the dual pen printers produced images, such as photographic images, which had a "grainy" appearance. For example, when printing a light colored portion of an image, such as a flesh tone, yellow dots were printed and lightly interspersed with magenta dots. When viewed at a distance, these magenta dots provided a flesh tone appearance; however, upon closer inspection the magenta dots were quite visible, giving the image an undesirable grainy appearance. This grainy appearance was similar to the graininess seen in newspaper photographs, or in photos taken using the wrong speed ("ASA" or "ISO" rating) of photographic film in low light conditions.

Indeed, inkjet printing mechanisms are known as "binary drop devices" because they form images by either placing a drop of ink on the print medium or by not firing. Not firing a droplet leaves either the print medium, or a previously printed drop(s), exposed to view. Unfortunately, such binary drop devices give inherently grainy images due to the visual "step" between the "drop on" and "drop off" regions. Worse yet, the larger the drops printed, the more grainy the resulting image appears, whether printing color or gray-scale images.

These earlier inkjet printers provided crisp black text and bright vivid graphics and charts, yet they failed to provide images of near photographic type quality, such as portraits, scenic landscapes, and other natural appearing images. Other devices have been used to provide high quality images, such as continuous tone devices some of which use a dye sublimation processes. Unfortunately, these continuous tone devices are expensive, and very unlikely to be viable within the small office and home printer markets, which currently sell printers to consumers within the range of $200–$1,000 dollars.

Another printing system, known as an imaging printing system has been proposed. Using a basic dual pen printer, typically constructed for a monochrome (e.g. black) cartridge and a tri-color (e.g. cyan, magenta, yellow) cartridge, the monochrome cartridge is replaced with a tri-chamber "imaging cartridge." While the normally installed tri-color cartridge carries full colorant concentrations of inks, the imaging cartridge typically carries ink formulations having reduced colorant concentrations. For instance, the imaging cartridge may contain reduced colorant concentrations of cyan and magenta, and either a full or a reduced concentration of black ink. Of course, pens containing other color and concentration combinations may also be interchanged with the monochrome cartridge. For instance, two full color cartridges may be installed if extensive color graphics are being printed, such as for business charts. However, one true beauty of the imaging system is realized when the reduced colorant concentrations are used in the imaging cartridge in combination with a full color concentration cartridge. By interspersing droplets of reduced colorant concentration with droplets of the full colorant concentrations, the resulting images have a near photographic quality.

Unfortunately, in a dual pen inkjet printer, this ability to interchange the monochrome and multi-cartridges presents a unique set of problems when it comes to servicing of both types of cartridges. FIG. 13 is a sectional bottom view of a first prior art capping system, shown in cross section sealing the orifice plate of a multi-chamber tri-color pen P1, while FIG. 14 is a sectional rear elevational view taken along line 14—14 of FIG. 13. FIG. 15 is a sectional bottom view of a second prior art capping system, shown in cross section sealing the orifice plate of a monochrome black pen P2. FIG. 16 is a sectional rear elevational view taken along line 16—16 of FIG. 15. The color pen P1 has a silicon orifice or nozzle plate S1 that defines three sets of nozzles A, B and C (each aligned in a pair of linear nozzle arrays), as shown in FIG. 13. The black pen P2 has a silicon orifice or nozzle plate S2 that defines one set of nozzles D, aligned in two linear arrays, as shown in FIG. 15.

As shown in FIGS. 13–16, these previous designs have used two different methods of capping the color and black printheads, based on the printhead geometry. In these figures, the silicon nozzle plates S1, S2 are attached by encapsulant beads E to a portion of an electrical flex circuit F1 for pen P1, and flex circuit F2 for pen P2. The flex circuits F1, F2 deliver firing signals to energize the printhead resistors which are associated with each nozzle in sets A–C, D. An energized resistor heats the ink until a droplet is ejected from the nozzle associated with the energized resistor.

As can be seen in FIGS. 14 and 16, the encapsulant beads E project beyond the outer surface of the nozzle silicon S1, S2. In the past, separate caps have been used to seal the black pen P1 and the color pen P2, with each cap avoiding the encapsulant bead regions. FIGS. 13 and 14 show a prior art color cap G sealing along the outer surface of the flex circuit F1, surrounding both the silicon S1 and the encapsulant beads E. FIGS. 15 and 16 show a prior art black cap H surrounding the nozzles D, and sealed directly against the silicon S2, between the encapsulant beads E.

Unfortunately, these prior art cap designs G and H were not interchangeable. The black cap H could not seal the color pen P1 against the silicon S1 because there is not enough room between the nozzle groups A, B, C and the encapsulant beads E to seat the cap H. Conversely, the color cap G could not seal the black pen P2 around the exterior of the silicon S2 because toward an interconnect side I of pen P2, there is a hollowed-out or notched region N where there is no flex circuit or plastic with which to form a seal. In other words, for the black pen P2 the sealing surface along the interconnect side I ends abruptly almost at the edge of the silicon S2.

As a further complication to interchangeably sealing both the black and tri-chamber pens, their orifice plates differ in their distance, here in elevation, from the print media. For instance, a black pen may be on the order of 0.6 mm (millimeters) closer to the print media than a tri-color pen. These differences in pen-to-media spacing enhance the print quality but complicate the problem of trying to seal both pens with the same cap. Using a conventional cap, such as G or H, to seal the color pen (farthest from the media) with an adequate force would result in too great a force when the same cap was used to seal the black pen. Sealing the black pen with such a great force may cause the elastomeric cap lips to buckle and perhaps to take a permanent set, which would then fail to seal a color pen when installed. Conversely, using the correct capping force for the black pen (closest to the media), would result in a cap would not even touch the color pen when installed.

One other earlier capping system, is currently commercially available in the DeskJet® 850C and DeskJet® 855C model color inkjet printers, sold by the Hewlett-Packard Company of Palo Alto, Calif. The black and tri-color cartridges used in these printers have a different design than the cartridges illustrated herein, so different challenges were encountered in designing suitable capping systems. The capping system in these earlier printers used a multiple sealing lip system to seal along the length of (parallel to) the encapsulant beads, not across (perpendicular to) the beads which is the challenge faced here. That is, in this earlier design the multiple sealing lips were parallel to the encapsulant beads to accommodate for manufacturing tolerance accumulation, so at least one of the multiple lips would land in a suitable location on the silicon to form a seal.

To solve the dilemma of sealing two different style printheads, of course two different caps could be installed in a service station, one for accommodating each type of pen when installed in the printer. However, such a two cap system is cumbersome, requiring extra physical space within the printer, which leads to a larger product that many consumers find undesirable. Moreover, such a two cap system, one for accommodating each type of pen, unfortunately increases the cost of the resultant printer, by requiring extra parts and assembly steps. Thus, it is desirable to have a universal capping system which is capable of sealing both monochrome and multi-chamber printheads.

SUMMARY OF THE INVENTION

According to one aspect of the present invention a universal capping apparatus is provided for sealing a printhead of a cartridge installed in an inkjet printing mechanism which has a frame. The printhead has an orifice plate that defines a group of ink ejecting nozzles extending therethrough. The installed cartridge may be either (1) a first style inkjet cartridge having a printhead with a first arrangement of nozzles, or (2) a second style inkjet cartridge having a printhead with a second arrangement of nozzles different from the first nozzle arrangement. The universal capping system includes a sled coupled to the printing mechanism frame for movement to a sealing position. The capping system includes a cap assembly supported by the sled to engage and seal the printhead of the installed cartridge when the sled is moved to the sealing position. The cap assembly includes a cap of a resilient material having a body, and a sealing lip projecting from the body. The sealing lip forms a sealing chamber adjacent the printhead when the sealing lip engages the printhead of an installed cartridge. The sealing lip is sized to surround either the first arrangement of nozzles or the second arrangement of nozzles. The sealing lip has a plural ridge portion that includes plural adjacent lip segments.

According to a further aspect of the present invention a cap assembly is provided for sealing a printhead of a cartridge installed in an inkjet printing mechanism, which has a sled that is moveable into a sealing position for sealing said printhead. The cap assembly has a base unit and a cap. The base unit has a platform and a mounting assembly to couple the base unit to the sled. The cap is constructed of a resilient material to have a body. The cap body includes a mounting portion that resiliently grips the platform of the base unit. The cap also has a sealing lip that projects from the body. The sealing lip forms a sealing chamber adjacent to the printhead when the base unit is coupled to the sled and the sled is moved into the sealing position. The base unit platform cooperates with the mounting portion of the cap to define a vent passageway. The vent passageway has a first port that is in communication with the sealing chamber, and a second port that is open to atmosphere.

According to another aspect of the present invention, a capping apparatus is provided for sealing an inkjet printhead of an inkjet printing mechanism. The printhead has an orifice plate defining a group of ink ejecting nozzles extending therethrough. The capping apparatus includes a sled that is moveable into a sealing position. The capping apparatus also has a cap assembly supported by the sled to engage and seal the printhead when the sled is moved to the sealing position. The cap assembly comprises a cap of a resilient material. The cap has a body and a sealing lip that projects from the body to surround the nozzles and engage the orifice plate and define a sealing chamber between the cap and orifice plate when in the sealing position. The sealing lip includes an asymmetrical lip segment that has an asymmetrical cross sectional shape which is selected to control the direction of bending of the asymmetrical lip segment when in the sealing position.

According to an additional aspect of the present invention an inkjet printing mechanism is provided with such a universal capping apparatus and cap assembly.

One goal of the present invention is to provide a capping system for sealing different interchangeable styles of inkjet cartridges, and more particularly to enable recording realistic photographic type images on plain paper by an inkjet printer so equipped.

A further goal of the present invention is to provide a robust universal capping system capable of reliably sealing the nozzles of either a monochrome single-chamber inkjet cartridge or a multi-chamber inkjet cartridge.

BRIEF DESCRIPTION OF THE DRAWINGS

FIG. 11 is a sectional bottom view of the universal cap assembly of FIG. 2 shown in cross section sealing a single-chamber style inkjet cartridge.

FIG. 12 is a side elevational, sectional view of one form an alternate embodiment of a universal inkjet printhead cap assembly of the present invention.

FIG. 15 is a sectional bottom view of a second prior art capping system, shown in cross section sealing a single-chamber style inkjet cartridge.

FIG. 16 is a rear elevational view taken along line 16—16 of FIG. 15.

DETAILED DESCRIPTION OF THE PREFERRED EMBODIMENTS

Figure 1:
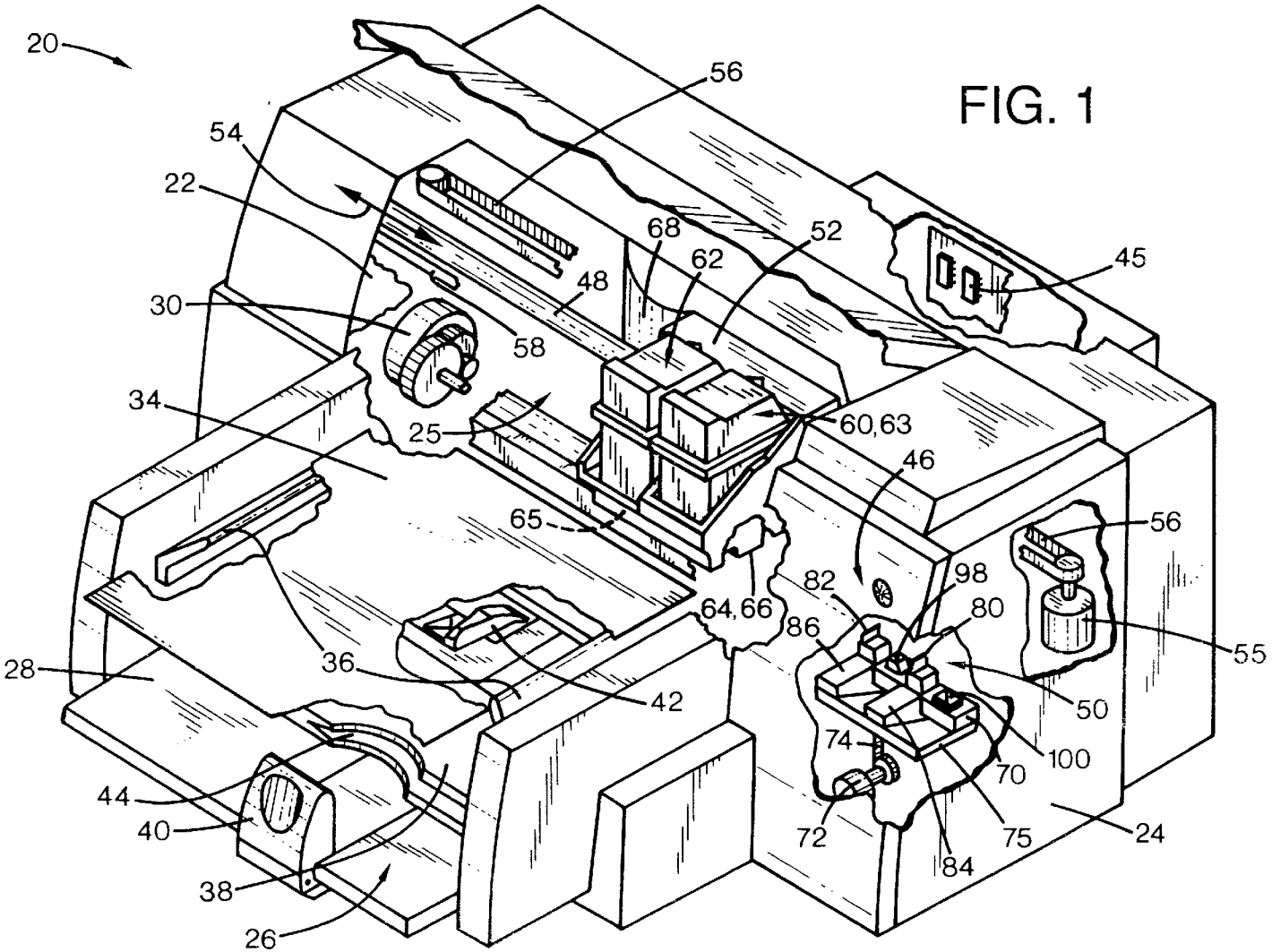
FIG. 1 is a fragmented, partially schematic, perspective view of one form of an inkjet printing mechanism having a service station with a universal capping system of the present invention for sealing the printhead of either a single-chamber or a multi-chamber style inkjet cartridge.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a print zone 25 by a print media handling system 26. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional paper drive rollers (not shown), driven by a stepper motor and drive gear assembly 30, may be used to move the print media from tray 28 into the print zone 25, as shown for sheet 34, for printing. After printing, the motor 30 drives the printed sheet 34 onto a pair of retractable output drying wing members 36. The wings 36 momentarily hold the newly printed sheet above any previously printed sheets still drying in an output tray portion 38 before retracting to the sides to drop the newly printed sheet into the output tray 38. The media handling system 26 may include a series of adjustment mechanisms for accommodating different sizes of print media, including letter, legal, A-4, envelopes, etc., such as a sliding length adjustment lever 40, a sliding width adjustment lever 42, and a sliding envelope feed plate 44.

The printer 20 also has a printer controller, illustrated schematically as a microprocessor 45, that receives instructions from a host device, typically a computer, such as a personal computer (not shown). The printer controller 45 may also operate in response to user inputs provided through a key pad 46 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 48 is supported by the printer chassis 22 to extend over the print zone 25 and a service station 50, which is also supported by the chassis 22. The guide rod 48 slideably supports a dual inkjet pen carriage 52 for travel back and forth across the print zone 25 along a scanning axis 54. The carriage 52 is also propelled along guide rod 48 into a servicing region over the service station 50. A carriage drive gear and DC motor assembly 55 is coupled to drive an endless belt 56. The motor 55 operates in response to control signals received from the controller 45. The belt 56 may be secured in a conventional manner to the carriage 52 to incrementally advance the carriage along guide rod 48 in response to rotation of motor 55.

To provide carriage positional feedback information to printer controller 45, an encoder strip 58 extends along the length of the print zone 25 and over the service station 50. A conventional optical encoder reader may also be mounted on the back surface of printhead carriage 52 to read positional information provided by the encoder strip 58. The manner of attaching the belt 56 to the carriage, as well as the manner providing positional feedback information via the encoder strip reader, may be accomplished in a variety of different ways known to those skilled in the art.

In the print zone 25, the media sheet 34 receives ink from an inkjet cartridge, such as a single-chamber style, black ink cartridge 60, and/or a multi-chamber style, full color ink cartridge 62. As mentioned in the Background portion above, an imaging printing system has been proposed where the single-chamber black pen 60 is replaced with a multi-chamber imaging cartridge 63. The imaging cartridge 63 illustrated herein has the same general construction as the full color pen 62, but instead may carry reduced colorant concentrations of ink, as described further below. These inkjet cartridges 60, 62 and 63 are also often called "pens" by those in the art.

The illustrated pens 60, 62 and 63 each include reservoirs or chambers for storing a supply of ink, and printheads 64, 65 and 66 respectively, for selectively ejecting the ink. The illustrated full color pen 62 is a multi-chamber pen having three reservoirs or chambers containing three ink colors, such as full colorant concentrations of cyan, yellow and magenta inks. While the color pen 62 may contain a pigment based ink, for the purposes of illustration, pen 62 has dye based inks. The black ink pen 60 is illustrated herein as a single-chamber cartridge containing a pigment based ink. It is apparent that other types of inks may also be used in the illustrated cartridges, such as paraffin based inks, as well as hybrid or composite inks having both dye and pigment characteristics.

While the black and color pens may be of different sizes, in the illustrated embodiment, the pens 60, 62 are of substantially the same size. The carriage 52 may be modified to interchangeably accommodate narrow and wider pens, for instance, by using the concepts disclosed in U.S. Pat. No. 5,208,610, assigned to the present assignee Hewlett-Packard Company.

Each printhead 64–66 has an orifice plate with a plurality of nozzles formed therethrough in a manner well known to those skilled in the art. The illustrated printheads 64–66 are thermal inkjet printheads, although other types of printheads may be used, such as piezoelectric printheads. The printheads 64–66 typically include substrate layer having a plurality of resistors which are associated with the nozzles. Upon energizing a selected resistor, a bubble of gas is formed to eject a droplet of ink from the nozzle and onto sheet 34 in the print zone 25. Ink may also be ejected into a spittoon portion of the service station 50 during servicing, or to clear plugged nozzles. The printhead resistors are selectively energized in response to firing command control signals delivered by a multi-conductor strip 68 from the printer controller 45 to the printhead carriage 52.

The single-chamber style cartridge 60 may be of the same construction as the prior art single-chamber pen P2, and the multi-chamber style cartridges 62, 63 may be of the same construction as the prior art multi-chamber pen P1, both described in the Background section above. Thus, to simplify the explanation herein, the components of cartridges 62, 63 and 60 are assigned the same item letters/numbers as the corresponding components of pens P1 and P2, respectively (i.e.: silicon nozzle plates S1, S2; sets of nozzles A–C, D; encapsulant beads E; electrical flex circuits F1, F2; and an interconnect side I of the pens, which electrically couples the pens to the carriage 52 to receive firing command control signals from the controller 45 via the multi-conductor strip 68).

As also mentioned in the Background section, graininess was experienced in printing photographic type images when using only a black pen 60 and a tri-color pen 62 carrying full colorant concentrations of cyan, yellow and magenta inks. To eliminate this graininess, an imaging printing system has been proposed where the single-chamber black pen 60 is replaced with the multi-chamber imaging cartridge 63. The imaging cartridge 63 illustrated herein has the same general construction as the full color pen 62, but instead carries at least some reduced colorant concentrations of ink.

For instance, a reduced colorant concentration may be composed by maintaining the same amount of solvent or carrier for a given pen capacity while reducing the amount of dye or pigment in the concentration from that conventionally used for a full concentration. Reduced colorant concentrations of cyan and magenta are often preferred, rather than yellow because visually, yellow is a low contrast color, and any graininess of the yellow ink is not visually detectable to the human eye. Yet, in other embodiments, the third chamber may contain an ink formulation of either a reduced or full concentration of yellow colored ink, or a full or reduced concentration of black ink. For instance, a reduced yellow concentration may enhance transition regions in areas of flesh tones. However, use of the imaging cartridge 63 without yellow has been found to significantly enhance the visual appearance of light tones and mid-tones in photographic type images, particularly when compared to the earlier dual pen printers, which had only full colorant concentrations. Allowing replacement of an imaging cartridge 63 with the full colorant concentration of black ink in pen 60 is advantageous for printing clear, crisp black text, while a reduced colorant concentration black in the imaging cartridge provides better, photographic-type images.

Table 1 lists a variety of different interchangeable pen and ink formulation combinations, which may be implemented to provide a dual (or multiple) personality printer, capable of producing a variety of different types of output, each with outstanding print quality.

TABLE 1

| Two Pen Carriage Ink Formulation Combinations | | | |
|---|---|---|---|
| | Interchangeable Carriage Position | | Other Position |
| Options | First Cartridge (Pen 60) | Second ("Imaging") Cartridge (Pen 63) | Third Cartridge (Pen 62) |
| Business | True Black | Partial C, M & Gray | Full C, M, Y |
| Imaging 1 | — | Partial C, M & True Black | Full C, M, Y |
| Imaging 2 | — | Partial C, M, Y | Full C, M, Y |
| Imaging 3 | — | Partial R, G, B | Full C, M, Y |
| Imaging 4 | — | Full R, G, B | Full C, M, Y |
| Imaging 5 | — | Gray | Full C, M, Y |

In Table 1, the following abbreviations are used: C for cyan, M for magenta, Y for yellow, R for red, G for green, and B for blue, with "full" indicating a full colorant concentration, and "partial" indicating a partial or reduced colorant concentration. "Gray" as used herein is considered to be a reduced colorant concentration of black colorant. The "first cartridge" corresponds to the single-chamber style black pens P2 or 60, the "second cartridge" is the imaging cartridge 63 having the same multi-chamber construction as pens P1 or 62, and the "third cartridge" has the multi-chamber construction of pens P1 or 62. The first and second cartridges are illustrated as being interchangeable, which leads to the problem (solved by the illustrated service station 50) of how to adequately seal two different styles of inkjet cartridge printheads using a single cap.

For the printer 20 and controller 45 to distinguish whether the black pen 60 or the imaging pen 63 is installed in carriage 52, the pens may each have a unique identifier for automatic recognition by the controller 45, such as a distinct binary code and/or resistors of different resistances. These identifiers are decodeable by the software or firmware of the printer controller 45, and/or the software of a printer driver, located in a host computer or device which communicates with printer 20. One suitable identification scheme for interchangeable printheads is disclosed in U.S. Pat. No. 4,872,027, also assigned to the present assignee, Hewlett-Packard Company. Alternatively, an operator may indicate which cartridge is installed, by making an appropriate entry into a host computer or by merely pressing a button on the keypad 46. Upon communication of which pen is installed in carriage 52, the software driver within the host computer or printer then uses an appropriate rendering scheme suitable to which ever pen is installed. The printer controller 45 then employs suitable print modes and control parameters to generate firing signals that are communicated via strip 68 through the carriage 52 to properly fire the installed cartridge.

Universal Capping System

Figure 2:
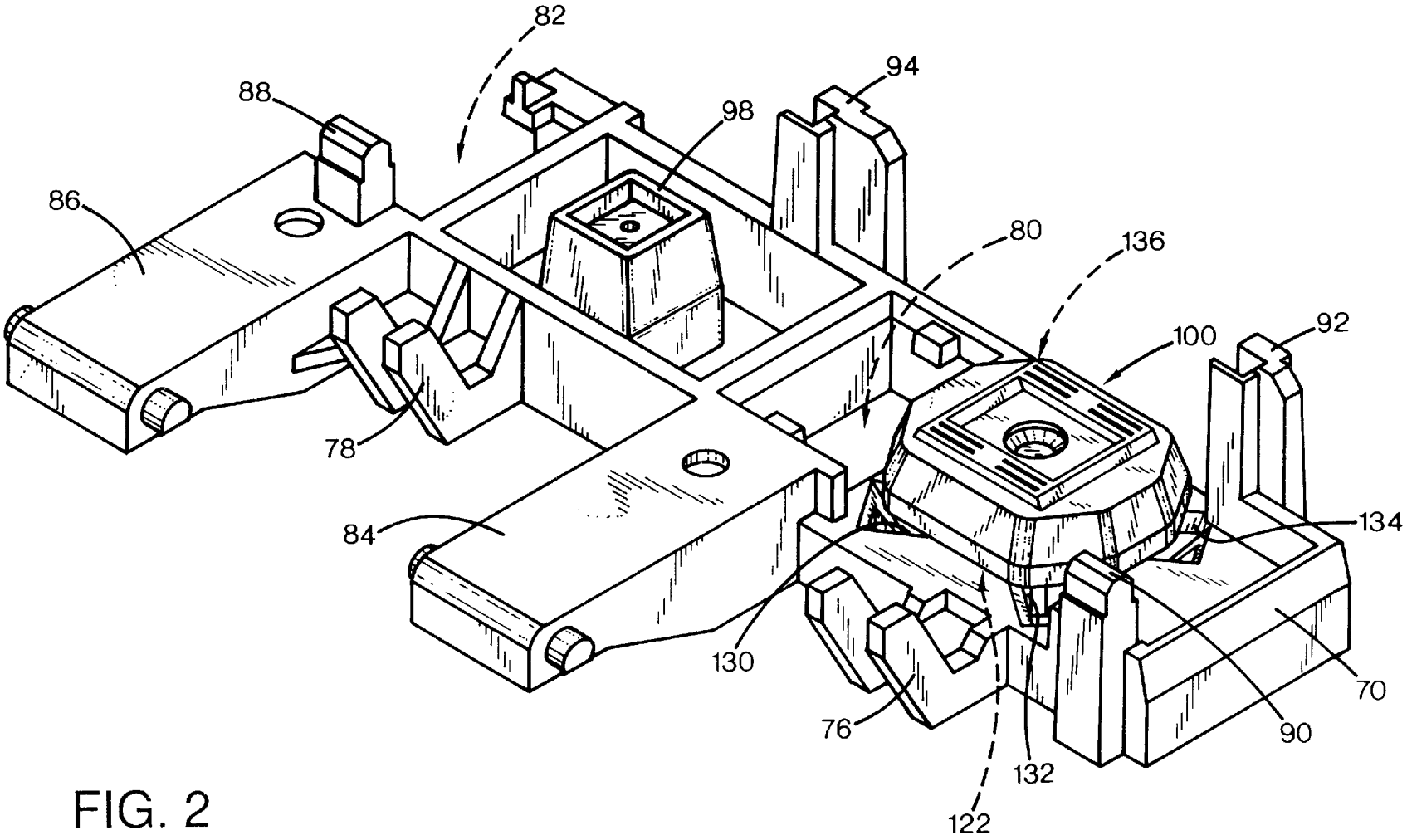
FIG. 2 is a perspective view of a portion of the service station of FIG. 1, including a universal inkjet printhead cap assembly of the present invention, capable of sealing both single-chamber and multi-chamber style inkjet cartridges.

FIGS. 1 and 2 show one embodiment of the printhead service station 50 constructed in accordance with the present invention for servicing the single-chamber inkjet cartridges 60, and multi-chamber inkjet cartridges 62, 63. The service station 50 includes a sled 70 that supports various servicing implements. During printing the sled 70 is at a rest position, lowered away from the path of printhead travel. To initiate servicing, a service station motor 72 moves the sled 70, preferably via a conventional rack and pinion gear mechanism 74, toward the printheads 65 and 64 or 66, which have been moved by carriage 50 to the servicing region. The sled 70 is coupled to the rack and pinion gear mechanism 74 by a base unit 75, shown schematically in FIG. 1, for instance, using two sets of mounting arms 76, 78 (FIG. 2). The gear mechanism 74 and base unit 75 may be constructed in any conventional manner to move the servicing implements into engagement with the respective printheads, for instance, by using the mechanism shown in U.S. Pat. No. 5,155,497, assigned to the present assignee, Hewlett-Packard Company. Other mechanisms may also be used to move the sled 70 into servicing positions, such as by moving sled 70 laterally up a ramp (not shown) using the concepts expressed in U.S. Pat. No. 5,440,331, also assigned to the present assignee, Hewlett-Packard Company.

The service station 50 includes a first wiper 80 and a second wiper 82 for wiping printheads 64, 65, respectively, when pens 60, 62 are installed in carriage 52. The first wiper wipes the printhead 66 of the multi-chamber imaging cartridge 63 when it is installed in carriage 52 instead of pen 60. The wipers 80, 82 are shown in FIG. 1, but are omitted from FIG. 2 (only their general location is shown) for clarity in explaining the remainder of the features of service station 50. The wipers 80, 82 are preferably of a resilient, non-abrasive, elastomeric material, such as nitrile rubber, or more preferably ethylene polypropylene diene monomer (EPDM), or other comparable materials known in the art.

The sled 70 has two support arms 84, 86 which extend forwardly from the main body of the sled to receive wiper support members (not shown) that receive the wipers 80, 82. A preferred wiper support structure for securing wipers 80, 82 to the sled 70 is currently commercially available in the DeskJet® 660C model color inkjet printer, sold by the Hewlett-Packard Company of Palo Alto, Calif. To assist in aligning the servicing components with the cartridges 60, 62, the sled 70 has two alignment members 88 and 90 located toward the front of the printer 20, and two rear alignment members 92 and 94 located toward the rear of sled 70. The service station 50 also has a color cap 98 for sealing printhead 66 of the color pen 60 during periods of printing inactivity. The color cap 98 may be of a conventional design, constructed of an elastomeric material, such as that described for the wipers 80, 82.

Figure 3:
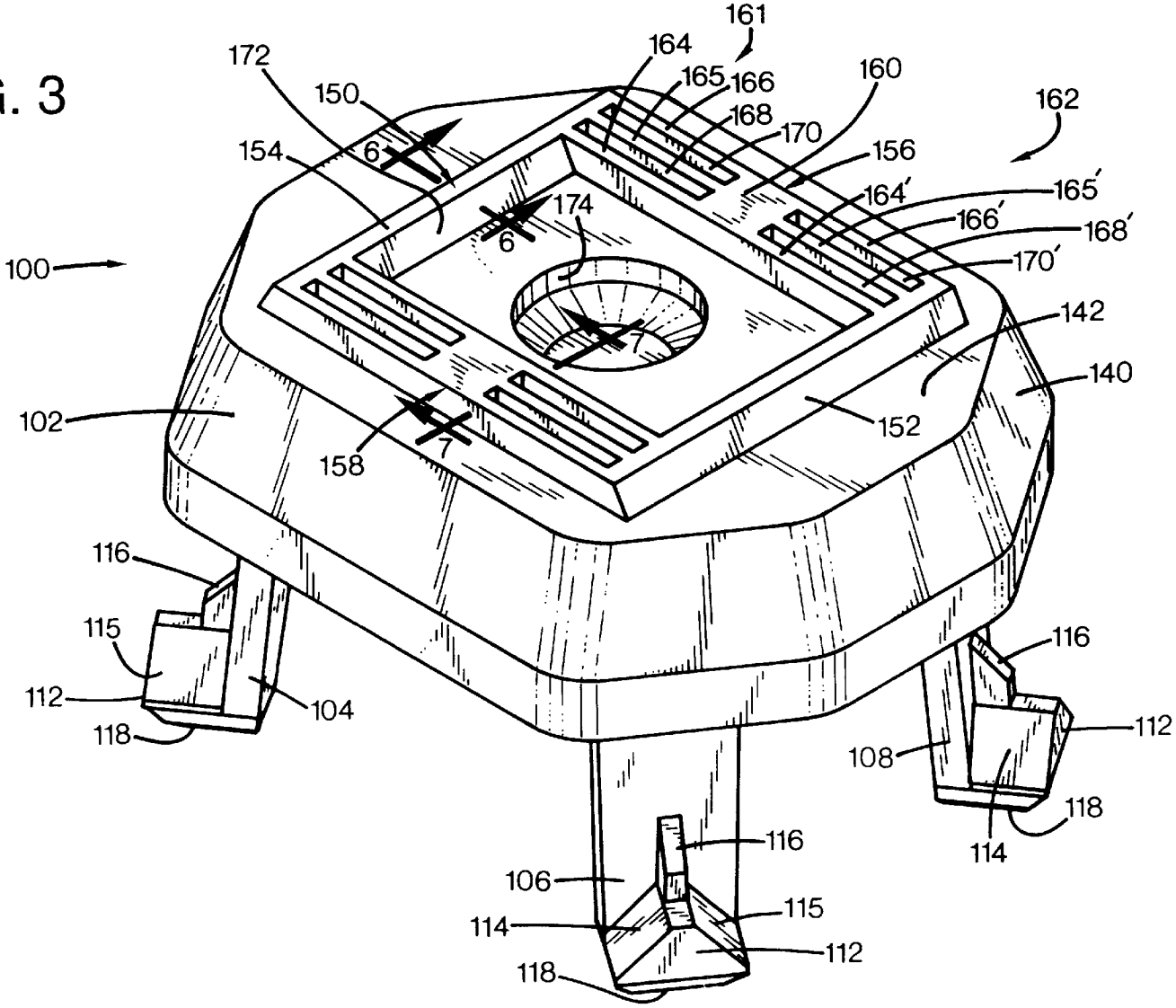
FIG. 3 is a top perspective view of the universal cap assembly of FIG. 2.
Figure 4:
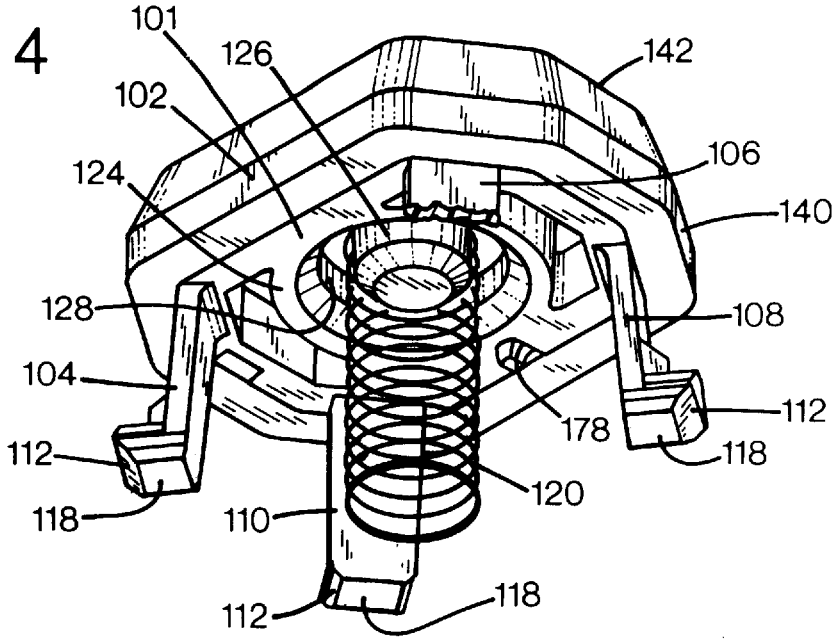
FIG. 4 is a fragmented, bottom perspective view of the universal cap assembly of FIG. 2.
Figure 5:
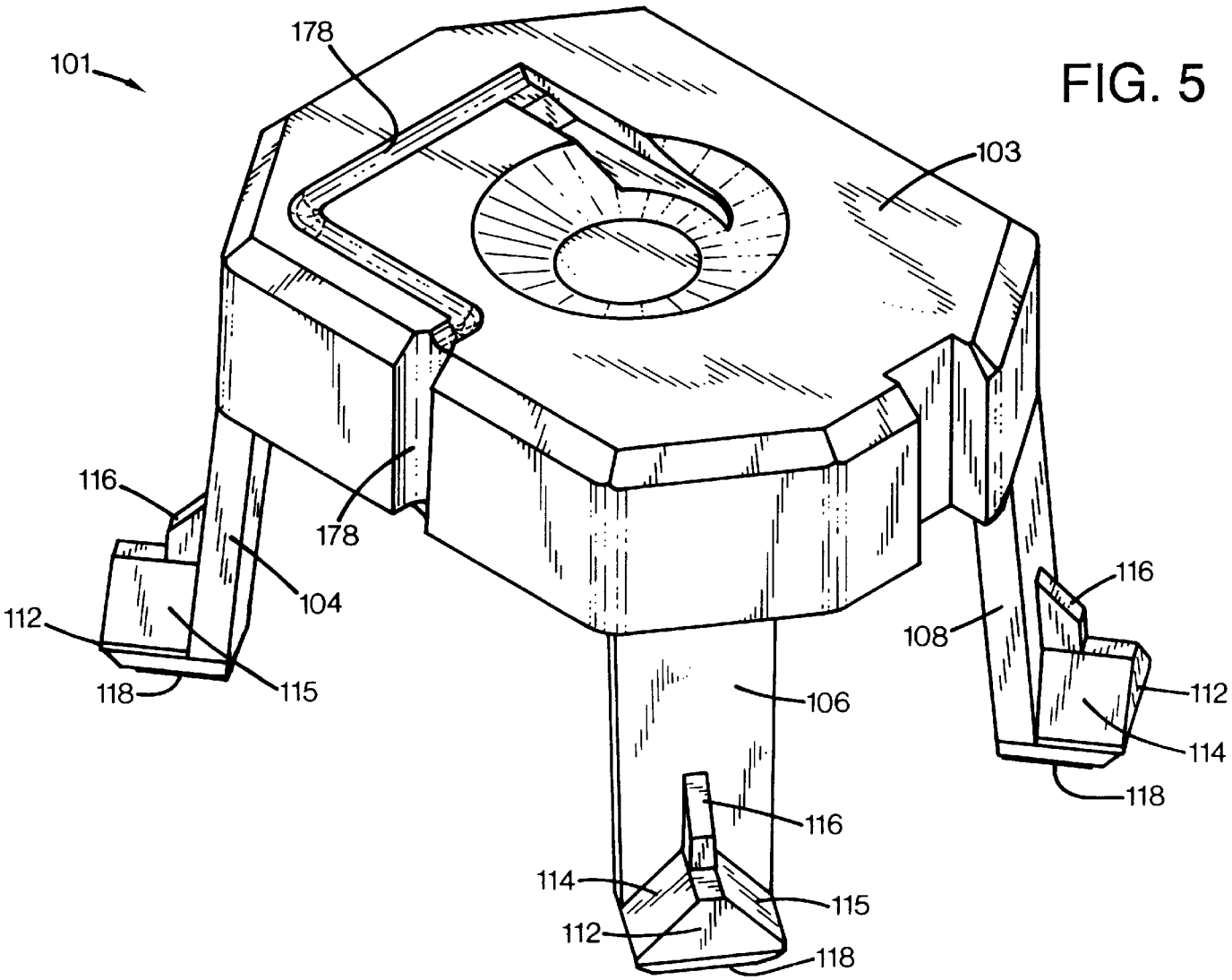
FIG. 5 is a top perspective view of a base unit of the universal cap assembly of FIG. 2.

Referring also to FIGS. 3–5, the service station 50 includes a multipurpose or universal capping system assembly 100, constructed in accordance with the present invention for sealing the printhead of either a single-chamber style inkjet cartridge, such as the black ink cartridge 60 or P2, or for sealing a multi-chamber style inkjet cartridge, such as imaging cartridge 63, depending upon which style pen is installed in carriage 52. The universal capping assembly 100 includes a base unit 101, preferably of a plastic material, and a cap 102 that covers a main platform portion 103 of the base 101. The base 101 joins the cap 102 to the service station sled 70. To couple the cap 102 to the sled 70, the base unit 101 has four downwardly projecting legs 104, 106, 108 and 110 which each terminate in a foot portion 112. Each foot 112 has an upwardly extending, truncated triangular cross section defined by two sloped surfaces 114, 115 which may be reinforced with a optional support rib 116. Each of the feet 112 also has a downwardly extending projection, terminating in a pad 118.

As shown in FIG. 4, a biasing member, such as a compression coil spring 120, is used to urge the base 101 away from the service station sled 70 and into engagement with the printhead of the installed cartridge. Preferably, the spring 120 is selected to have a preferred spring rate of 0.2–1.0N/mm (Newtons per millimeter), or more preferably a spring rate of 0.6N/mm, and a preferred force of 3.5–4.0N, or more preferably a force of 3.75N both at a compressed length of approximately 8.8 mm, and at a free length of approximately 15.0 mm.

The sled 70 defines a recessed pocket 122 located centrally under the cap assembly 100, as generally indicated by arrow 122, that receives the lower portion of the spring 120. To secure the upper end of spring 120, the lower interior portion of base 101 has an outer cylindrical projection 124 that surrounds a post 126 to define an annular recess 128 in the base. The annular recess 128 is sized to receive upper portion of spring 120 between cylinder 124 and post 126. Preferably, the base unit legs 104, 106, 108, 110 loosely fit within slots 130, 132, 134 and 136 defined by the service station sled 70. The loose fit of the legs 104–110 within slots 130–136 allows the base 101 to move downwardly toward the service station sled 70 during capping, which compresses spring 120. When not sealing a printhead, the sloped upper surfaces 114, 115 of each foot 112 then rest along the underside of the service station sled at a location slightly outboard from the associated slot 130–136.

The multipurpose cap 102 has a body 140 serving as lower mounting portion which surrounds and resiliently grips the platform portion 103 of the base unit 101. The cap body 140 terminates in an upper surface 142. The cap 102 also has a sealing lip portion 150, extending upwardly from the upper surface 142 of the cap body 140. In a preferred embodiment, the cap 102 is integrally constructed of a resilient, non-abrasive, elastomeric material, such as nitrile rubber, or more preferably ethylene polypropylene diene monomer (EPDM, or other comparable materials known in the art. Preferably, the durometer of the EPDM material of the cap 102 is selected between the range of 25–50, on the Shore A scale, with a more preferred range being between 30–40, with a preferred nominal value being about 35, plus or minus a standard tolerance, such as +/−5. It is apparent that the cap 102 may be made of different materials known to those skilled in the art, or of materials having other durometers.

Figure 6:
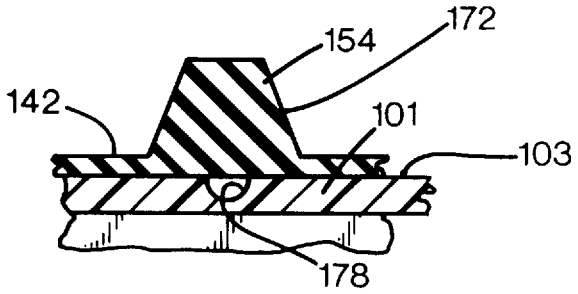
FIG. 6 is a front elevational view taken along line 6—6 of FIG. 3.
Figure 7:
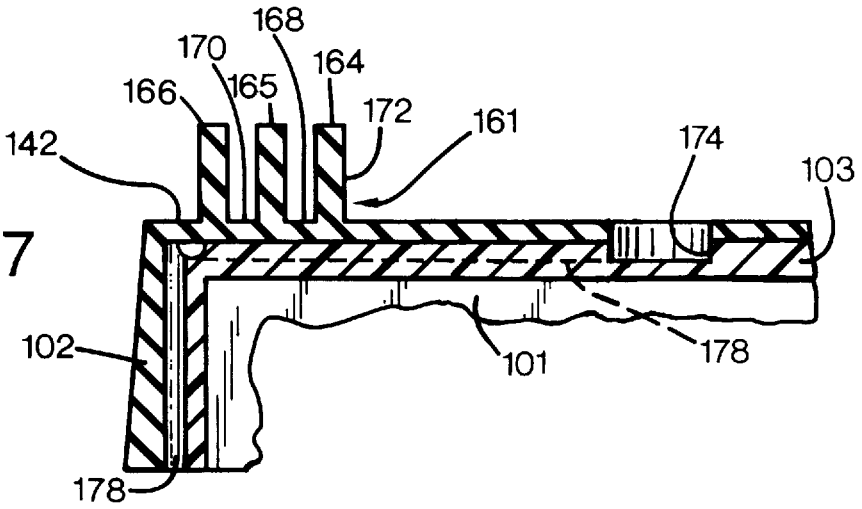
FIG. 7 is a side elevational view taken along line 7—7 of FIG. 3.

The sealing lip 150 includes a pair of opposing side lips 152 and 154 which each have a basically trapezoidal cross section, such as shown in FIG. 6. The side lips 152, 154 join two opposing sets of end lips 156 and 158, which are illustrated in cross section in FIG. 7. While the end lips sets 156, 158 may have differing geometries, in the illustrated embodiment they have the same construction, so a discussion of the features of lip set 156 will serve to illustrate the features of lip set 158 as well. The end lip set 156 includes one or more sublips and an optional intermediate support segment or brace wall portion 160, which divides the sublips into two groups 161 and 162. As shown, the first group of lip segments 161 comprises three sublips or lip segments, such as an interior lip segment 164, a medial lip segment 165, and an exterior lip segment 166. The brace wall 160 divides these lip segments 164–166 approximately half way along their length, leading to the generation of the second group of lip segments 162 comprising a matching triplet of sublip segments 164', 165' and 166', aligned parallel with the triplet of lip segments 164, 165 and 166, respectively, as shown. Preferably, these sublips 164–166, 164'–166' each have a rectangular cross section, as shown in FIG. 7. The interior and medial sublips 164–165 define an inboard trough or valley 168 therebetween, while sublips 164'–165' define a trough 168' therebetween. An outboard trough or valley 170 is defined between the medial and exterior sublips 165 and 166, whereas a trough 170' is defined to lie between sublips 165' and 166'.

As shown in FIGS. 8–11, these troughs 168, 168', 170, 170' allow room for the sublips 164–166, 164'–166' to buckle and bend, as well as be compressed, to adequately seal over the encapsulant beads E of the printheads for both the multi-chamber style inkjet imaging cartridge 63, and the single-chamber black cartridge 60. This sideways mushing-over or buckling action of the sublips (FIG. 10) advantageously provides an air-tight seal at a lower sealing force (in a direction toward the printheads 64, 66) than that achievable using pure compression of the sealing lips. The side lips 152, 154 and one or more of the sublips 164–166, 164'–166' of the end lip sets 156, 158 cooperate to form a nozzle sealing chamber 172 when the universal cap assembly 100 is moved into contact with either printhead 64 or printhead 66.

The multiple sealing system provided by the sublips 164–166, 164'–166' generates a reinforced or back-up sealing plan, so if one sublip fails to seat tightly against the silicon, one or both of the other sublips forms the seal. For instance, if any air gap exists in the corner region located between the encapsulant bead E, the silicon S1, S2 and the interior sublip 164, 164', then the medial and exterior sublips 165–166, 165'–166' serve to seal the next exterior region. Thus, subchambers defined by the silicon S1, S2 and the troughs 168, 168', 170, 170' may also serve as a portion of the sealing chamber 172, depending upon how the cap lip 150 happens to engage the installed printhead during a particular capping sequence.

To prevent the cap 102 from forcing air into the nozzles A–C or D of printheads 64 or 66, the base platform 103 defines a vent hole 174 therethrough. The upper surface and a side surface of the base platform 103 may have a vent trough 178 formed therein to define a vent passageway 178 extending from chamber 172 to atmosphere. Preferably the portion of trough 178 along the upper surface of platform 103 is located approximately under a portion of the sealing lip system 150. This location of trough 178 advantageously assures that the trough is sealed by the interior surface the cap body 140 during capping.

Thus, a vent chamber having a controlled dimension is provided between trough 178 and the interior surface the cap body 140 to minimize drying of the ink within the sealed printhead. The vent chamber allows excess pressure to bleed out of the sealing chamber 172 as sealing is initiated, so de-priming of the printhead (by forcing air into the nozzles) is avoided. The vent chamber is also useful for accommodating for variations in barometric pressure, or changes in elevation during printer transport. While the vent trough 178 is illustrated as being formed in the base unit 101, it is apparent that the vent trough may also be formed in whole or in part along the underside of the cap body 140. Some prior capping systems required a separate plug system for venting purposes, so the illustrated cap 102 and base unit 101 advantageously minimize the number of parts required to manufacture the printer 20, yielding a more economical product for consumers.

Figure 8:
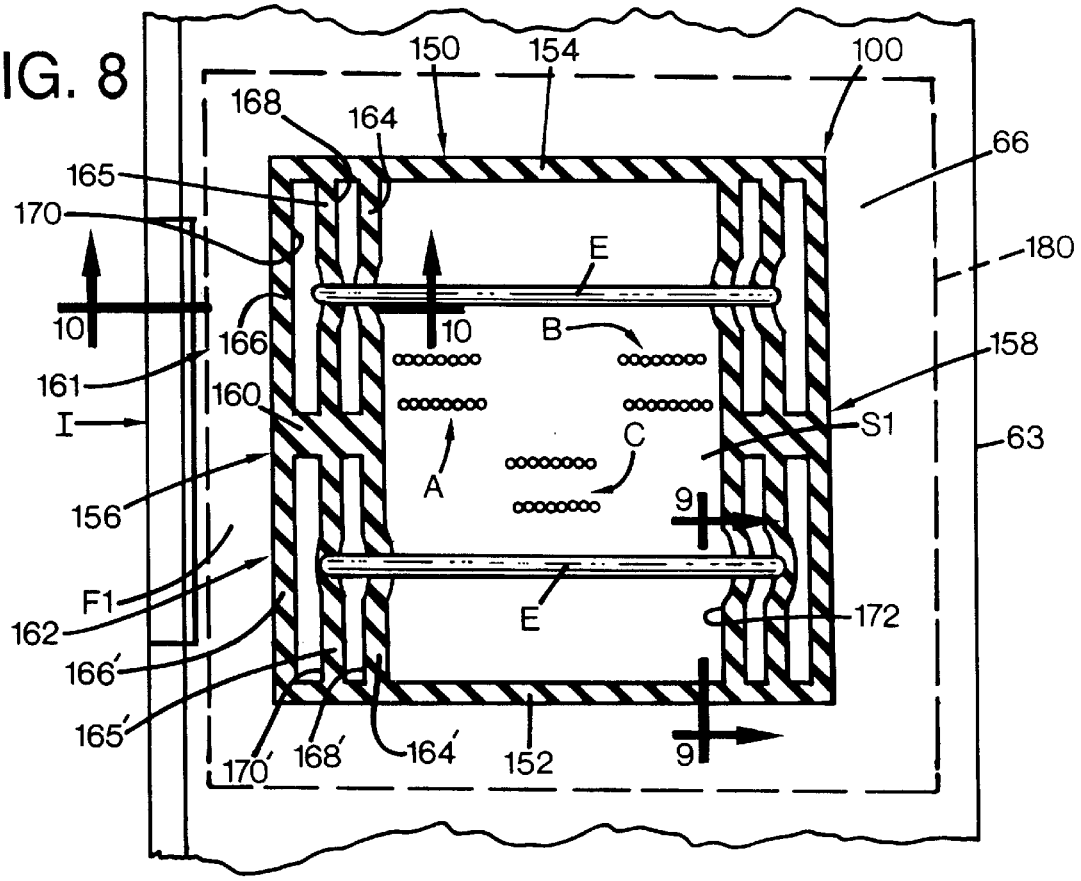
FIG. 8 is a sectional bottom view of the universal cap assembly of FIG. 2 shown in cross section sealing a multi-chamber style inkjet cartridge.
Figure 9:
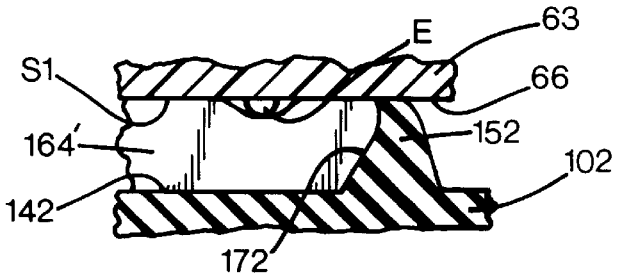
FIG. 9 is a rear elevational view taken along line 9—9 of FIG. 8.
Figure 10:
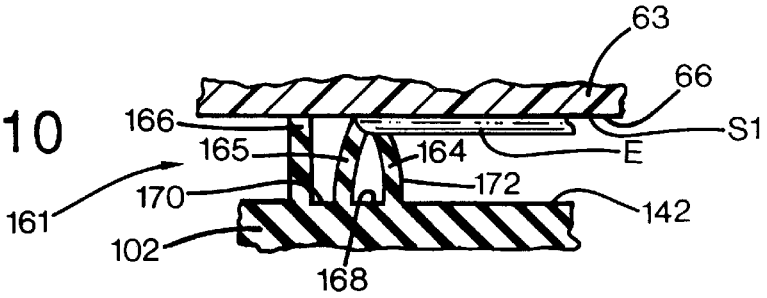
FIG. 10 is a side elevational view taken along line 10—10 of FIG. 8.
Figure 13:
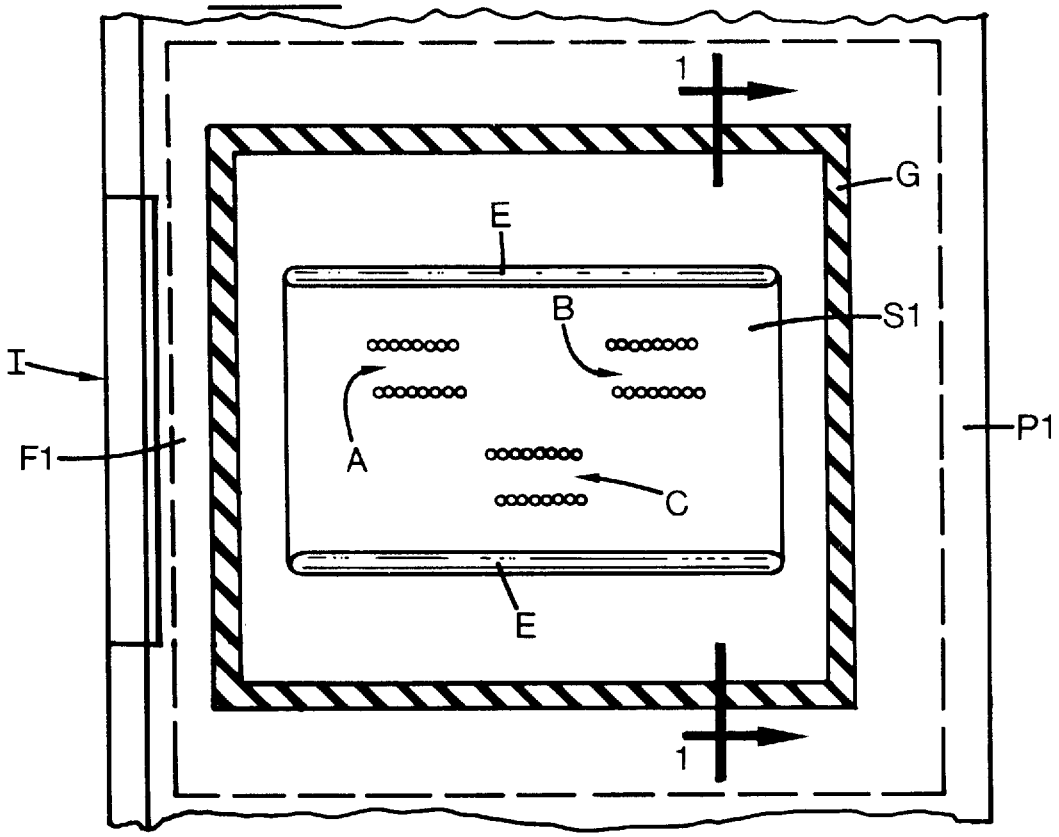
FIG. 13 Prior Art
FIG. 13 is a sectional bottom view of a first prior art capping system, shown in cross section sealing a multi-chamber style inkjet cartridge.

FIG. 8 shows the imaging printhead 66 being sealed by the universal cap 100. A dashed line 180 in FIG. 8 indicates the maximum outboard seating area available on printhead 66 for sealing contact with the lip system 150, whereas the inner boundary of sealing chamber 172 is illustrated at the minimum inboard seating limit for printhead 66. Thus, the lip system 150 may be varied in size, here increased to the dashed line 180, and still adequately seal printhead 66. As shown, the side lips 152, 154 extend parallel to the encapsulant beads E, and lie outside of the beads E, sealing against the outer plastic surface of flex circuit F1. Advantageously, the universal cap 100 seals across the encapsulant beads E using the sublips 162–166' of the end lip sets 156 and 158, a feature which was not possible using the prior art color cap G (FIGS. 12–13). As shown in FIGS. 9 and 10, the sublips 162–166' are able to conform to the shape of the encapsulant beads E to hermetically seal the imaging printhead 66.

Figure 14:
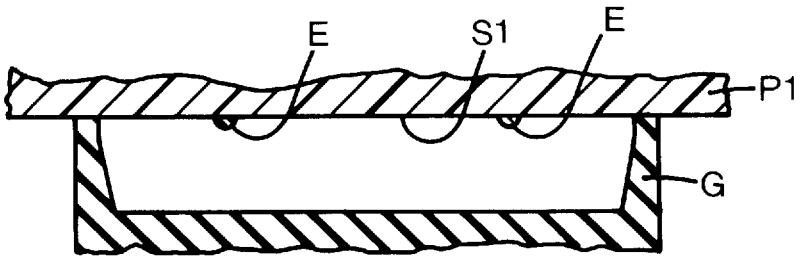
FIG. 14 Prior Art
FIG. 14 is a rear elevational view taken along line 14—14 of FIG. 13.

FIG. 11 shows the universal cap 100 sealing the black printhead 64. A dashed line 182 in FIG. 11 indicates the maximum outboard seating area available on printhead 64 for sealing contact with the lip system 150, whereas the inner boundary of sealing chamber 172 is illustrated at the minimum inboard seating limit for printhead 64. Thus, the lip system 150 may be varied in size, here increased to the dashed line 182, and still adequately seal printhead 64. As illustrated, the sublips 162–166' accommodate and seal over the encapsulant beads E, in the same manner shown in FIGS. 9 and 10 for the imaging printhead 66. The black printhead 64 is sealed by the side lips 152, 154 exterior to the encapsulant beads E, which differs from the prior art sealing system shown in FIGS. 14 and 15, where the caps sealed against the silicon S2 only. In FIG. 11, the side lips 152, 154 seal against the outer plastic surface of flex circuit F2 lying to the exterior of the encapsulant beads E.

This universal cap 100 advantageously uses sublips 162–166' which have a rectangular cross section (see FIGS. 7 and 10). This rectangular cross section provides tall, thin sublips, which are more flexible, and more likely to buckle and conform to printhead surface irregularities than the side lips 152, 154 which have a trapezoidal cross section (see FIGS. 6 and 9). To conform the sublips 162–166' over the encapsulant beads E requires more force be applied by the cap toward the printhead than experienced using prior cap designs. Earlier cap designs, such as caps G and H (FIGS. 12–15) allowed the cap material to flex to create the seal at the printhead. Thus, the cap lips of the earlier designs (discussed in the Background portion above) were taller, extending a greater distance from the sled toward the printhead. This greater lip height was needed so the earlier caps G, H could flex and adequately seal against printheads in the earlier systems. Unfortunately, such a flexible cap lip (G, H) could not accommodate the varying different heights of the printheads, since the black printhead 64 sits in carriage 52 at a height that is approximately 0.6 mm lower than the imaging printhead 66.

To generate the proper capping force to accommodate both the black and imaging printheads 64, 66, the cap base 101 is mounted on biasing spring 120, yielding a hard sprung design for cap 100. Differing levels of compression for spring 120 allows the universal capping assembly 100 to accommodate for the different printhead-to-media spacings, here differing elevations, of the printheads 64 and 66. Using the coil spring 120 under the cap base 101 allowed the spring rates to be low enough so that the universal capping system 100 yields acceptable forces for sealing both the single-chamber and the multi-chamber style pens 60 and 63.

FIG. 12 shows an alternate embodiment of a multipurpose or universal cap 200, constructed in accordance with the present invention, which may be substituted for cap 102 of FIGS. 1–4 and 6–11. This alternate cap 200 may have the same basic structure as cap 102, so except for the interior sublip, like components are numbered the same as can be seen from a comparison of FIG. 12 with FIG. 7. The cap 200 has an interior lip segment or sublip 210, which has an asymmetrical cross sectional shape selected to control its bending or buckling during capping. The sublip 210 has an interior wall 212 and an exterior wall 214.

It is desirable to avoid having the interior lip buckle inwardly during sealing, which in an extreme case may interfere with the nozzles. Thus, it is preferable to control the buckling of the interior lip so it bends outwardly into trough 168. To accomplish this goal, the interior wall 212 is strengthened and the exterior wall 214 is weakened. Upon capping, the exterior wall 214 yields before the interior wall 212 so the compression action pushes the sublip toward trough 168, as indicated in dashed lines in FIG. 12.

There are a variety of ways to make the interior wall 212 stronger than the exterior wall 214, such as by varying the structural strength of the walls. For instance, the exterior wall may be weakened by removing material from a sublip having a rectangular cross section, such as by forming a series of vertical grooves (not shown) along the exterior wall of sublip 164. A more preferred approach is shown in FIG. 12 where material has been added to strengthen the interior wall 212. In one aspect, the asymmetrical sublip 210 may be considered to be a hybrid sublip, having the rigidity of a trapezoidal (cross section) lip, such as side lip 152, along the interior wall 212, and the flexibility of a rectangular (cross section) lip, such as sublip 164, along the exterior wall 214.

The degree of bending relative to the amount of compression experienced by the asymmetrical sublip 210 during capping may be controlled by varying an angle θ, which determines the slope of the interior wall 212. For example, assume that the sublip 210 is shown in FIG. 12 at a nominal slope. When the angle θ is smaller than shown, the interior wall 212 is inclined more toward vertical, so the sublip 210 buckles more and compresses less. Larger values for angle θ then decrease buckling and increase the compression of the sublip 210 during capping. Thus, the balance of the relative degrees of buckling and compression may be easily controlled or tuned by varying the slope angle θ, assuming other design parameters, such as durometer, are held constant.

I claim:

1. A universal capping apparatus for sealing a printhead of a cartridge installed in an inkjet printing mechanism which has a frame, with the printhead having an orifice plate defining a group of ink ejecting nozzles extending therethrough, with the installed cartridge being either (1) a first style inkjet cartridge having a printhead with a first arrangement of nozzles, or (2) a second style inkjet cartridge having a printhead with a second arrangement of nozzles different from the first nozzle arrangement, the universal capping apparatus comprising:

a sled coupled to the printing mechanism frame for movement to a sealing position; and a cap assembly supported by the sled to engage and seal the printhead of the installed cartridge when the sled is moved to the sealing position, with the cap assembly comprising a cap of a resilient material having a body and a sealing lip projecting from the body, with the sealing lip forming a sealing chamber adjacent the printhead when the sealing lip engages the printhead of an installed cartridge, with the sealing lip sized to surround either the first arrangement of nozzles or the second arrangement of nozzles, the sealing lip including a plural ridge portion comprising plural adjacent lip segments, wherein the cap assembly further includes a base unit having a platform and a mounting assembly coupling the base unit to the sled, the cap body includes a mounting portion resiliently gripping the platform of the base unit, and wherein the base unit platform defines a trough which cooperates with an undersurface of the mounting portion of the cap to form a vent passageway between the trough and the under surface of the cap mounting portion, with the vent passageway having a first port in communication with the sealing chamber and a second port open to atmosphere.

2. A universal capping apparatus according to claim 1, wherein the plural ridge portion comprises two groups of lip segments, and the sealing lip further includes a support segment that separates the two groups of lip segments.

3. A universal capping apparatus according to claim 1, wherein two adjacent lip segments are separated from each other by a trough.

4. A universal capping apparatus according to claim 1, wherein the plural lip segments are substantially mutually parallel.

5. A universal capping apparatus according to claim 1, wherein at least one lip segment has a substantially rectangular cross section.

6. A universal capping apparatus according to claim 1, wherein the sealing lip also has a single ridge portion.

7. A universal capping apparatus according to claim 6 wherein:

the single ridge portion has a first width; and at least one of the lip segments has a second width which is greater than the first width.

8. A universal capping apparatus according to claim 6 wherein:

the single ridge portion has a first flexibility; and at least one of the lip segments has a second flexibility which is greater than the first flexibility.

9. A universal capping apparatus according to claim 6 wherein the single ridge portion has a substantially trapezoidal cross section.

10. A universal capping apparatus for sealing a printhead of a cartridge installed in an inkjet printing mechanism which has a frame, with the printhead having an orifice plate defining a group of ink ejecting nozzles extending therethrough, with the installed cartridge being either (1) a first style inkjet cartridge having a printhead with a first arrangement of nozzles, or (2) a second style inkjet cartridge having a printhead with a second arrangement of nozzles different from the first nozzle arrangement, the universal capping apparatus comprising:

a sled coupled to the printing mechanism frame for movement to a sealing position, wherein the sled has an upper surface and a lower surface, and the sled defines plural cap mounting holes extending between the upper surface and the lower surface; and a cap assembly supported by the sled to engage and seal the printhead of the installed cartridge when the sled is moved to the sealing position, with the cap assembly comprising a cap of a resilient material having a body and a sealing lip projecting from the body, with the sealing lip forming a sealing chamber adjacent the printhead when the sealing lip engages the printhead of an installed cartridge, with the sealing lip sized to surround either the first arrangement of nozzles or the second arrangement of nozzles, the sealing lip including a plural ridge portion comprising plural adjacent lip segments, wherein the cap assembly further includes a base unit having a platform and a mounting assembly coupling the base unit to the sled, and the cap body includes a mounting portion resiliently gripping the platform of the base unit; and wherein the base unit mounting assembly comprises plural leg members extending from the platform, with each leg member received by an associated one of the plural cap mounting holes to support the base unit platform above the sled upper surface, and with each leg member terminating foot portion resting against the sled lower surface when the sled is in a rest position, and with the leg members each having a loose fit within said cap mounting holes to allow the base unit to move downwardly toward the sled when in the sealing position.

11. A universal capping apparatus according to claim 1 further including a biasing element captured between the base unit and the sled to urge the platform away from the sled.

12. A universal capping apparatus according to claim 1 wherein the cap defines a vent hole joining the sealing chamber with the first port of the vent passageway.

13. A universal capping apparatus according to claim 12 wherein a portion of the trough is located under the cap mounting portion at a location under a portion of the sealing lip.

14. A universal capping apparatus according to claim 1 wherein the sealing lip includes an asymmetrical lip segment having an asymmetrical cross sectional shape selected to bend the asymmetrical lip segment in a direction away from the ink ejecting nozzles when in the sealing position.

15. A cap assembly for sealing a printhead of a cartridge installed in an inkjet printing mechanism which has a sled which moves into a sealing position for sealing said printhead, the cap assembly comprising:

a base unit having a platform and a mounting assembly to couple the base unit to the sled, with the platform defining a trough therein; and a cap of a resilient material having a body with an under surface, and with the body including a mounting portion resiliently gripping the platform of the base unit so the body under surface rests against the platform, with the cap also having a sealing lip projecting from the body, with the sealing lip forming a sealing chamber adjacent the printhead when the base unit is coupled to the sled and the sled is moved into the sealing position;

wherein the base unit platform trough cooperates with the mounting portion of the cap to define a vent passageway between the trough and the body under surface, with the vent passageway having a first port in communication with the sealing chamber and a second port open to atmosphere.

16. A cap assembly according to claim 15 wherein the base unit platform a has an upper surface and a side surface which together define the trough for the vent passageway.

17. A cap assembly according to claim 15 wherein a portion of the trough is located under the cap mounting portion at a location under a portion of the sealing lip.

18. A cap assembly according to claim 15 wherein the cap defines a vent hole joining the sealing chamber with the first port of the vent passageway.

19. A cap assembly according to claim 15 wherein the sealing lip has a plural ridge portion comprising plural adjacent lip segments.

20. A cap assembly for sealing a printhead of a cartridge installed in an inkjet printing mechanism which has a sled which moves into a sealing position for sealing said printhead, the cap assembly comprising:

a base unit having a platform and a mounting assembly to couple the base unit to the sled; and a cap of a resilient material having a body including a mounting portion resiliently gripping the platform of the base unit, with the cap also having a sealing lip projecting from the body, with the sealing lip forming a sealing chamber adjacent the printhead when the base unit is coupled to the sled and the sled is moved into the sealing position;

wherein the base unit platform cooperates with the mounting portion of the cap to define a vent passageway having a first port in communication with the sealing chamber and a second port open to atmosphere; and wherein the sealing lip has a plural ridge portion comprising plural adjacent lip segments, and wherein the plural ridge portion comprises two groups of lip segments, and the sealing lip further includes a support segment separating the two groups of lip segments.

21. A cap assembly according to claim 15 for sealing said printhead which has an orifice plate defining plural ink ejecting nozzles extending therethrough, wherein the sealing lip includes an asymmetrical lip segment having an asymmetrical cross sectional shape selected to bend the asymmetrical lip segment in a direction away from said plural ink ejecting nozzles when in the sealing position.

22. An inkjet printing mechanism for printing with an installed one of two interchangeable inkjet cartridges each having an orifice plate defining a group of ink ejecting nozzles extending therethrough, with the installed inkjet cartridge being selected from either (1) a first style inkjet cartridge having a printhead with a first arrangement of nozzles, or (2) a second style inkjet cartridge having a printhead with a second arrangement of nozzles different from the first nozzle arrangement, the inkjet printing mechanism comprising:

a frame defining a printzone and into a servicing region;

a carriage assembly mounted to the frame for reciprocal motion across the printzone and into the servicing region, with the carriage being configured to receive the selected inkjet cartridge;

a sled coupled to the printing mechanism frame for movement between a rest position and a sealing position; and a cap assembly supported by the sled to engage and seal the printhead of the installed cartridge when the sled is moved to the sealing position, with the cap assembly comprising a cap of a resilient material having a body and a sealing lip projecting from the body, with the sealing lip forming a sealing chamber adjacent the printhead when the sealing lip engages the printhead of an installed cartridge, with the sealing lip sized to surround either the first arrangement of nozzles or the second arrangement of nozzles, the sealing lip including a plural ridge portion comprising plural adjacent lip segments, wherein the cap assembly further includes a base unit having a platform and a mounting assembly coupling the base unit to the sled, the cap body includes a mounting portion resiliently gripping the platform of the base unit, and the base unit platform defines a trough which cooperates with the mounting portion of the cap to form a vent passageway having a first port in communication with the sealing chamber and a second port open to atmosphere.

23. A capping apparatus for sealing an inkjet printhead of an inkjet printing mechanism, the printhead having an orifice plate defining a group of ink ejecting nozzles extending therethrough, the capping apparatus comprising:

a sled which moves into a sealing position; and a cap assembly supported by the sled to engage and seal the printhead when the sled is moved to the sealing position, with the cap assembly comprising a cap of a resilient material having a body and a sealing lip projecting from the body to surround the nozzles and engage the orifice plate and define a sealing chamber between the cap and orifice plate when in the sealing position, with the sealing lip including an asymmetrical lip segment having an asymmetrical cross sectional shape selected to bend the asymmetrical lip segment in a direction away from the ink ejecting nozzles when in the sealing position, wherein the sealing lip further includes an exterior ridge portion parallel to the asymmetrical lip segment, with the asymmetrical lip segment being located closer to the nozzles than the exterior ridge portion when in the sealing position.

24. A capping apparatus according to claim 23 wherein the sealing lip further includes a plural ridge portion comprising plural adjacent lip segments.

25. A capping apparatus according to claim 24 wherein the asymmetrical lip segment is located closer to the nozzles than any of the plural adjacent lip segments of the plural ridge portion when in the sealing position.

26. A capping apparatus according to claim 23 wherein the asymmetrical cross sectional shape is selected to control the direction of bending of the asymmetrical lip segment toward the exterior ridge portion.

27. A capping apparatus according to claim 23 wherein the asymmetrical cross sectional shape is also selected to control compression of the asymmetrical lip segment when in the sealing position.

28. A capping apparatus for sealing an inkjet printhead of an inkjet printing mechanism, the printhead having an orifice plate defining a group of ink ejecting nozzles extending therethrough, the capping apparatus comprising:

a sled which moves into a sealing position; and a cap assembly supported by the sled to engage and seal the printhead when the sled is moved to the sealing position, with the cap assembly comprising a cap of a resilient material having a body and a sealing lip projecting from the body to surround the nozzles and engage the orifice plate and define a sealing chamber between the cap and orifice plate when in the sealing position, with the sealing lip including an asymmetrical lip segment having an asymmetrical cross sectional shape selected to bend the asymmetrical lip segment in a direction away from the ink ejecting nozzles when in the sealing position;

wherein the cap assembly further includes a base unit having a platform and a mounting assembly coupling the base unit to the sled;

wherein the cap body includes a mounting portion that resiliently grips the platform of the base unit; and wherein the base unit platform defines a trough which cooperates with the mounting portion of the cap to form a vent passageway having a first port in communication with the sealing chamber and a second port open to atmosphere.

* * * * *